US005534081A

United States Patent [19]

Takagi et al.

[11] Patent Number: 5,534,081

[45] Date of Patent: Jul. 9, 1996

[54] FUEL INJECTOR COMPONENT

[75] Inventors: Yosiaki Takagi; Jun Takizawa, both of Saitama-ken; Katsuaki Fukushima, Shimane-ken, all of Japan

[73] Assignees: Honda Giken Kogyo Kabushiki Kaisha; Hitachi Metals, Ltd., both of Tokyo, Japan

[21] Appl. No.: 241,433

[22] Filed: May 11, 1994

[30] Foreign Application Priority Data

May 11, 1993 [JP] Japan ..... 5-132883
Jun. 8, 1993 [JP] Japan ..... 5-163980

[51] Int. Cl.[6] ..... C22C 38/22

[52] U.S. Cl. ..... 148/325; 148/326

[58] Field of Search ..... 148/325, 326, 148/548, 607

[56] References Cited

U.S. PATENT DOCUMENTS 4,985,092 1/1991 Kaede et al. ..... 148/326

*Primary Examiner*—Deborah Yee
*Attorney, Agent, or Firm*—Skjerven, Morrill, MacPherson, Franklin & Friel; Thomas S. MacDonald

[57] ABSTRACT

To the end of providing a fuel injector component such as a nozzle needle and a valve seat of a fuel injector for injecting fuel directly into a combustion chamber of a gasoline engine which has a sufficient durability and wear resistance even in the high temperature condition existing in the combustion chamber of the gasoline engine, the fuel injector component is made of a martensite stainless steel essentially consisting of 0.6 to 1.5% of C; 2.0% or less of Si; 1.0% or less of Mn; 10 to 18% of Cr; 1 to 6% of a member selected from a group consisting of Mo and Mo+(½)W; and a balance of Fe and inevitable impurities. The material may further comprise, in various combinations, 2% or less of V and/or Nb in terms of V+(½)Nb, 6% or less of Co, 3.5% or less of Cu, and at least one member of a group consisting of 0.2% or less of Pb, 0.05% or less of S, and 0.1% or less of Se.

14 Claims, 1 Drawing Sheet

FUEL INJECTOR COMPONENT

TECHNICAL FIELD

The present invention relates to a component of a fuel injector such as a nozzle needle, a nozzle body defining a valve seat for the nozzle needle, and other components of a fuel injector which may be exposed to a high temperature, and in particular to such a fuel injector component made of a material which makes it suitable for use in a fuel injector for injecting gasoline fuel directly into a combustion chamber of a gasoline engine as opposed to a fuel injector for injecting fuel into an intake manifold.

BACKGROUND OF THE INVENTION

The requisite properties for the material of a fuel injector component such as a nozzle needle and a nozzle body defining a valve seat for the nozzle needle of a fuel injector for a gasoline engine include the wear resistance of the sliding parts, and the resistance against the corrosion due to the moisture contained in the fuel. Because the mass produced fuel injectors for gasoline engines are normally used for injecting fuel into an intake manifold of the engine where the prevailing temperature is no more than 150° C., the nozzle needles and the valve seats of these fuel injectors are made of JIS (Japanese Industrial Standards) -SUS440C stainless steel which is hardened and tempered at a temperature lower than 200° C.

As a part of the efforts to reduce the emission from engines, extensive research efforts have been directed to the development of lean burn engines. Some of the lean burn engines use fuel injectors which inject fuel directly into the cylinders or the combustion chambers of the engine. In such engines, part of each fuel injector is inevitably exposed to a combustion gas of high temperature, and the capability of the fuel injector to withstand heat is a major problem. More specifically, when fuel is directly injected into the combustion chamber of an engine, if the material for the fuel injector consists of the stainless steel tempered at low temperature, it will be further tempered during use. Therefore, for the material to retain its hardness and dimensional stability, it must be tempered at a temperature higher than 400° C.

However, if the JIS-SUS440C is tempered at such a high temperature, the following problems will arise:

(1) Reduction in corrosion-resistance due to the precipitation of secondary Cr—Fe double carbides; and (2) Reduction in hardness and wear-resistance due to the softening resulting from tempering and the subsequent exposure to a high temperature during use.

BRIEF SUMMARY OF THE INVENTION

In view of such problems of the prior art, a primary object of the present invention is to provide a fuel injector component made of a material which makes it suitable for use as a fuel injector component such as a needle valve and a valve seat of a fuel injector for injecting gasoline fuel directly into a combustion chamber or a precombustion chamber of an engine, and which can withstand the heat, and retain its corrosion resistance and wear resistance during use.

A second object of the present invention is to provide a fuel injector component made of a material which is economical but allows the component to be safely used in a fuel injector for directly injecting gasoline fuel into a combustion chamber or a precombustion chamber of a gasoline engine.

These and other objects of the present invention can be accomplished by providing a fuel injector component made of a martensite stainless steel for use in a fuel injector for injecting fuel directly into a combustion chamber of a gasoline engine, essentially consisting of: 0.6 to 1.5% of C; 2.0% or less of Si; 1.0% or less of Mn; 10 to 18% of Cr; 1 to 6% of a member selected from a group consisting of Mo and Mo+(½)W; and a balance of Fe and inevitable impurities. Optionally, the material may further comprise, in various combinations, 2% or less of V and/or Nb in terms of V+(½)Nb, 6% or less of Co, 3.5% or less of Cu, and at least one member of a group consisting of 0.2% or less of Pb, 0.05% or less of S, and 0.1% or less of Se. In this disclosure, the percentages are all given in terms of weight. "2% or less of V and/or Nb in terms of V+(½)Nb" means that when the two elements are both present, their total amount may range such that V+(½)Nb is 2% or less. For instance, if the content of V is zero or small, the content of Nb could be up to 4%.

When Mo, W and/or V is added to steel having a high content of C and Cr as is the case with the material of the present invention, the resulting primary carbides $M_7C_3$ and $M_{23}C_6$ essentially based on Cr take the forms of double carbides and other composite carbides by including Mo, W and/or V as solid solution. It was found that when the size of such composite carbides is large, cracks tend to develop in the abutting surfaces of the nozzle needle and the valve seat due to repeated impacts at high speed, eventually degrading the sealing capability of the nozzle needle and the cooperating valve seat. It was also found that this problem can be eliminated by controlling an average particle diameter of a primary carbide to be 15 μm or less, and it can be accomplished by a rapid quenching during the forging process, and by a hot working process.

Thus, by hardening martensite stainless steel including C, Si, Mn, Cr, Mo, etc., and tempering it at a high temperature in the range of 450° to 550° C., the stainless steel is hardened by the precipitation of secondary carbides. By making use of this secondary hardening process, the hardness at 300° C. can be improved to a level in excess of Hv 580 (Vickers hardness), preferably in excess of Hv 610 so that a sufficient wear resistance for a component of a fuel injector for directly injecting fuel into a cylinder or a combustion chamber of a gasoline engine can be achieved. Furthermore, this composition improves the properties of the stainless steel which are desirable for a fuel injector component of a cylinder injection type fuel injector such as corrosion resistance, wear resistance, hardness at high temperature, secondary hardening by tempering, creep resistance, and resistance against softening by tempering.

Now, the grounds for determining the composition of the material of the present invention are discussed in the following.

C exists in Fe as a solid solution, and is an essential element in converting the matrix into martensite. Further, C is essential in improving hardness and wear resistance by forming carbides with Cr, Mo, V, Nb and W. To achieve a hardness necessary for a fuel injector to which the present invention is to be applied, at least 0.6% ("%" used in this application should be understood as meaning "wt%") of C is required to be added. It is preferable to increase the content of C in view of improving wear resistance by forming carbides, but the hot working property of the material is impaired if the content of C is excessive. Thus, the preferable range of the content of C is 0.6 to 1.5%.

Si is added to deoxidize the steel, and contributes to the strengthening of the matrix, and the improvement of the mechanical strength and the wear resistance of the material. However, an excessive Si content impairs the hot working property of the material. Thus, the preferable range of the Si content is 2.0% or less.

Mn is an element used for smelting steel, and can improve the hardening property of the steel. However, Mn has the property to form austenire, and an excessive Mn content may therefore cause a reduction in hardness due to the excessive presence of residual austenire at the time of hardening, and dimensional instability over time. Thus, the preferable range of Mn is 1.0% or less.

Cr improves the corrosion resistance of steel by forming a passivation surface layer. Cr is also effective in improving resistance against softening when tempering, hardening property and creep resistance, and is essential in improving wear resistance by forming carbides in the forms of $M_7C_3$ and $M_{23}C_6$. Additionally, Cr is effective in improving the resistance of the material against oxidization. To maintain the surface of the material in a favorable condition when exposed to a temperature in excess of 300° C. as in the case of a cylinder injection type fuel injector, the Cr content must be 10% or higher. In particular, when the corrosion resistance of steel is to be improved, the Cr content must be 10% or higher, preferably 12% or higher. However, an excessive Cr content will reduce the hardness of the matrix, and impair the hot working property of the material. Thus, the preferable range of the Cr content is 10 to 18%.

Mo and W are effective in strengthening the matrix, and improving corrosion resistance and resistance against softening in tempering. Furthermore, through a high temperature tempering process, Mo and W form double carbides with Cr as well as normal carbides, and is effective in promoting secondary hardening and increasing hardness at high temperature. These elements are essential in improving corrosion resistance and wear resistance, but are relatively expensive. Thus, by taking into account both performance and cost, the preferable range of the content of these elements in terms of Mo+(½)W is 1 to 6%.

V and Nb precipitate secondary carbides, promote secondary hardening, increases mechanical strength at high temperature, and make the grains finer. As these elements have a greater tendency to form carbides than Cr and Mo, they indirectly improve the corrosion resistance of the material by increasing the contents of Cr and Mo in the matrix. V and Nb produce similar results, but because Nb has an atomic number which is approximately twice that of V, the V and Nb contents may be determined in terms of V+(½)Nb. These elements are expensive, and tend to form extremely hard carbides which will impair the machinability of the material. Thus, the range of the V and/or Nb contents in terms of V+(½)Nb is 2% or less.

Co strengthen the matrix, and improves the mechanical strength of the matrix at high temperature. It also helps to improve toughness and creep resistance. Additionally, Co stabilizes carbides, and improves wear resistance and corrosion resistance. Co is also an expensive element, and the range of the Co content is 6% or less by taking into account both performance and cost.

Cu improves the corrosion resistance of the matrix, and improves the machinability of the material by precipitating Cu solid solution. As it however significantly degrades the hot working property of the steel when added in excess of 4%, the preferable range of the Cu content is 3.5% or less.

S, Pb and Se improve the machinability of the steel, and tend to degrade wear resistance when added in excess. Because S and Pb also degrade corrosion resistance when added in excess, the preferable ranges of the S and Pb contents are 0.05% or less and 0.2% or less, respectively. Because Se is effective in improving corrosion resistance but degrades wear resistance, the preferable range of the Se content is 0.1% or less.

The nozzle needle and the valve seat of a fuel injector must have a sufficient hardness to ensure a sufficient wear resistance and durability. The Inventors have conducted wear tests on nozzle needles and valve seats made of material which are tempered at high temperature as described hereinafter, and have found that there is a strong correlation between the results of these tests with the hardness at 300° C. As mentioned earlier, the cylinder injection type fuel injectors are subjected to temperatures in excess of 300° C. during use. More specifically, it was found that a hardness of Hv 580 or higher, or more preferably, Hv 610 or higher is necessary for controlling the wear of the nozzle needle and the valve seat of a fuel injector to a level comparable to that of a fuel injector installed in an intake manifold.

BRIEF DESCRIPTION OF THE DRAWINGS

Now the present invention is described in the following with reference to the appended drawing, in which.

DETAILED DESCRIPTION OF THE PREFERRED EMBODIMENTS

Figure 1:
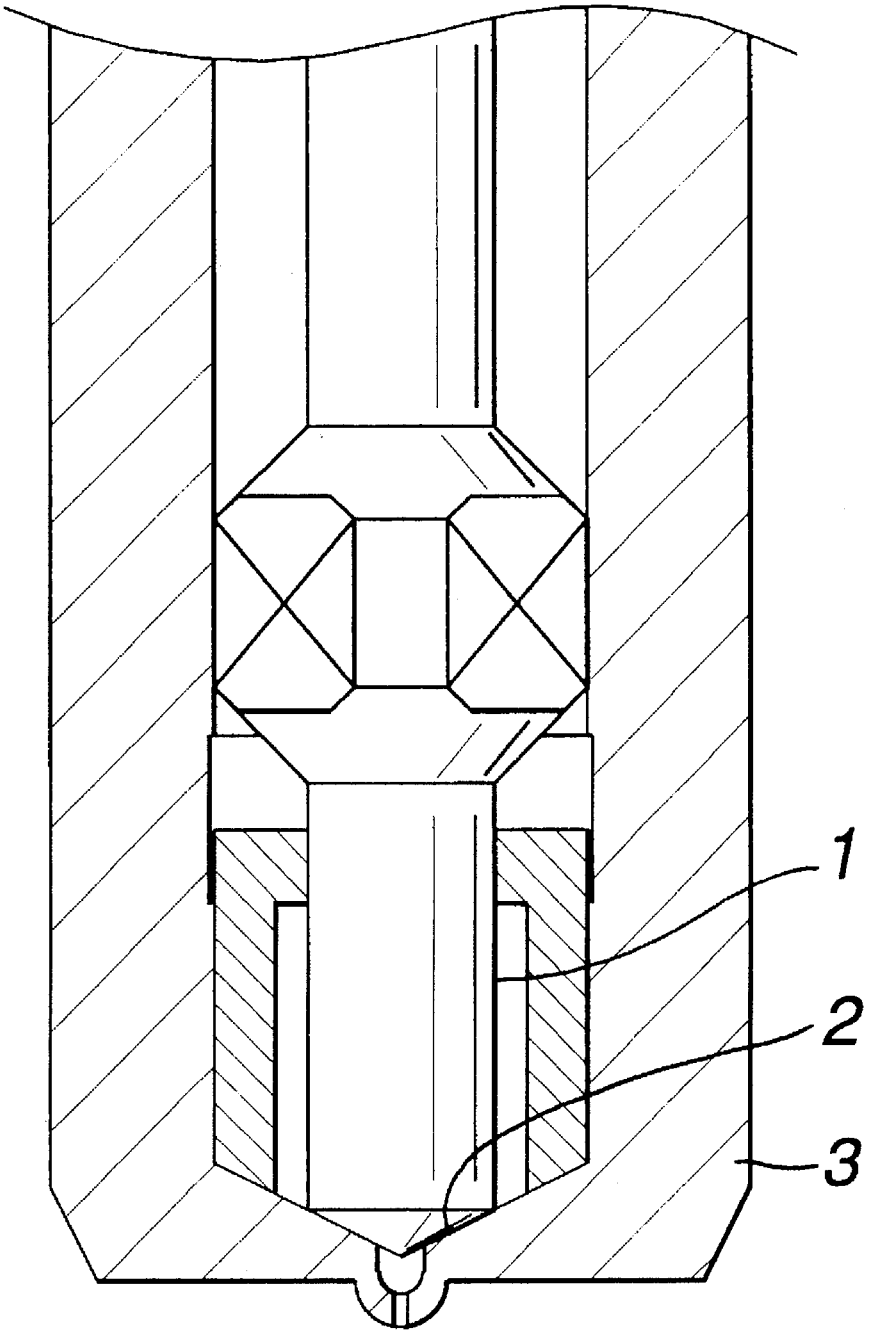
FIG. 1 is a sectional view of a fuel injector to which the present invention is applied.

Table 1 shows the various materials which were subjected to the above mentioned tests. In Table 1, #1 through #14 correspond to the materials according to the present invention which are suitable for use in nozzle needles and valve seats of fuel injectors. #15 corresponds to the conventional material for a normal fuel injector for gasoline engines which injects fuel into an intake manifold. #16 and #17 correspond to the materials for the nozzle needles and valve seats of fuel injectors for diesel engines. These conventional materials are all based on JIS.

The following tests were conducted on each of the materials after hardening and high temperature tempering; i.e., Vickers hardness tests at room temperature and at 300° C., wear resistance tests, durability tests in the assembled state, corrosion resistance tests, and machining tests. With respect to some of the materials, the average particle diameters of primary carbides were measured. The results of these test are summarized in Table 2.

TABLE 1

| No. | C | Si | Mn | Cr | Mo | W | V | Nb | Co | Cu | Pb | S | Se |
|---|---|---|---|---|---|---|---|---|---|---|---|---|---|
| | | | | | | | | | | | All in wt % | | [Bal. Fe] |
| | | | | | | present invention | | | | | | | |
| 1 | 1.02 | 0.23 | 0.40 | 13.63 | 3.49 | — | — | — | — | — | — | — | — |
| 2 | 1.02 | 0.31 | 0.48 | 14.03 | 3.68 | — | 0.23 | — | — | — | — | — | — |
| 3 | 1.05 | 0.35 | 0.82 | 14.52 | 4.53 | — | 0.18 | — | — | — | 0.06 | 0.015 | — |
| 4 | 0.97 | 0.35 | 0.38 | 13.99 | 3.46 | 0.48 | — | — | — | — | — | — | — |
| 5 | 0.63 | 1.05 | 0.39 | 10.28 | 5.86 | — | 0.32 | 0.14 | — | — | — | — | — |
| 6 | 0.72 | 0.89 | 0.46 | 12.78 | 1.92 | — | 0.29 | — | — | 1.08 | — | — | — |
| 7 | 0.74 | 0.72 | 0.39 | 12.88 | 1.48 | — | 0.30 | — | 1.47 | 2.38 | — | — | — |
| 8 | 1.12 | 0.12 | 0.11 | 15.37 | 3.79 | 2.90 | 0.97 | — | 5.89 | — | — | — | — |
| 9 | 1.15 | 1.02 | 0.42 | 17.91 | 1.12 | — | — | — | — | 0.97 | — | — | — |
| 10 | 1.47 | 1.89 | 0.38 | 14.12 | 3.89 | — | 1.82 | 0.20 | — | — | — | — | — |
| 11 | 1.05 | 0.37 | 0.51 | 14.02 | 3.74 | — | — | — | 4.20 | — | — | — | — |
| 12 | 1.02 | 0.31 | 0.47 | 13.97 | 3.01 | — | — | — | 1.51 | 2.42 | — | — | — |
| 13 | 1.08 | 0.32 | 0.93 | 14.62 | 4.48 | — | — | — | — | — | 0.16 | 0.028 | — |
| 14 | 0.97 | 0.42 | 0.47 | 14.18 | 3.77 | — | — | — | — | — | — | — | 0.09 |
| | | | | | | conventional | | | | | | | |
| 15 | 0.96 | 0.34 | 0.38 | 16.19 | 0.35 | — | — | — | — | — | — | — | — |
| 16 | 0.78 | 0.32 | 0.25 | 3.93 | — | 17.49 | 1.05 | — | — | — | — | — | — |
| 17 | 0.20 | 0.30 | 0.68 | 1.02 | 0.22 | — | — | — | — | — | — | — | — |

TABLE 2

| no | room temp. hardness | high temp. hardness | wear resistance | durability | corrosion resistance | machinability | average diameter or primary carbides | remarks |
|---|---|---|---|---|---|---|---|---|
| | | | | present invention | | | | |
| 1 | 690 | 605 | ○ | ○ | ○ | ○ | 13.2 | |
| 2 | 700 | 610 | ○ | ○ | ○ | ○ | 11.7 | |
| 3 | 690 | 600 | ○ | ○ | ○ | ◎ | 14.3 | |
| 4 | 695 | 610 | ○ | — | ○ | — | — | |
| 5 | 670 | 590 | Δ | — | Δ | — | — | |
| 6 | 675 | 585 | Δ | — | ○ | ○ | — | |
| 7 | 670 | 580 | Δ | ○ | ○ | ○ | 8.2 | |
| 8 | 805 | 715 | ○ | — | ○ | — | — | |
| 9 | 690 | 590 | ○ | — | Δ | ○ | — | |
| 10 | 780 | 700 | ○ | — | Δ | Δ | — | |
| 11 | 695 | 620 | ○ | ○ | ○ | — | 13.1 | |
| 12 | 685 | 610 | ○ | — | ○ | Δ | — | |
| 13 | 680 | 580 | Δ | — | Δ | ◎ | — | |
| 14 | 690 | 605 | Δ | — | ○ | ◎ | — | |
| | | | | conventional | | | | |
| 15 | 640 | 565 | × | × | × | ○ | 16.4 | equivalent to JIS SUS440C |
| 16 | 830 | 740 | Δ | — | × | × | — | equivalent to SKH-2 |
| 17 | 740[1)] | 545 | × | — | × | ◎ | — | SCM420H + carburizing |

[1)]surface hardness

The conditions of the tests and the heat treatments are summarized in the following:

(1) Wear resistance tests

Test method: chip on disk

Testing material: the same as the test piece (however, with regard to #16 and #17, the tests were conducted with a chip made of #16 and a disk made of #17 to simulate the situation in an actual diesel engine)

Surface pressure: 100 kgf/cm$^2$

Sliding speed: 1 m/sec

Ambient temperature: 250° C.

Lubrication: none

Test time: 20 min

Test Criteria: Each test result was compared with a reference result obtained by conducting the above mentioned test at 150° C. on a material prepared by tempering JIS-SU440C at 180° C. (HRC 59), and O, Δ, and X are assigned when the result is better, comparable, and poor, respectively.

(2) Assembly durability tests

A durability test was conducted on the samples which were actually installed in a fuel injector, and used at the operating temperature of 300° C. The fluctuation in the lift of the nozzle needle of the fuel injector was evaluated by using an oscilloscope after 300 million cycles of operation.

(3) Corrosion tests

Test method: immersion test

Test solution: ethanol+(1% NaCl aqua) 1%

Temperature: room temperature

Test criteria: By using the result obtained from a material prepared by tempering JIS-SUS440C at 480° C. as a reference, O, Δ and X were assigned if more than five times the reference time period was needed, if more than twice the reference time period was needed, and if less than twice the reference time period was needed to develop red rust.

(4) Machinability test

Test method: Comparing surface roughness after drilling

Test tool: spiral drill

Tool feed speed: 32 mm/min

Test piece condition: annealed

Test criteria: O, O, Δ and X were assigned depending on, as compared with JIS-SUS440C, if a better result was obtained, if a comparable result was obtained, if a slightly poorer result was obtained, and if a substantially poorer result was obtained.

(5) Heat treatment conditions for #1 through #15

Hardening: After being retained for two hours in vacuum at 1050° to 1100° C. (the temperature being varied depending on the composition of the test piece), the test piece was cooled by $N_2$ gas Subzero treatment: 30 minutes at −75° C.

Tempering: After being retained for 15 hours in vacuum at 480 to 520° C. (the temperature being varied depending on the composition of the test piece), the test piece was cooled by $N_2$ gas for #16

Hardening: 1250° C.

Tempering: twice at 540° C. for #17

Carburizing, hardening and tempering with an effective carburizing depth of 0.5 to 0.8 mm.

An essential part of the fuel injector to which the present invention is applied is illustrated in FIG. 1. In the drawing, numeral 1 denotes a nozzle needle, and numeral 2 denotes a valve seat defined in a nozzle body 3.

From Table 2, the following conclusions can be drawn.

Through proper composition of various elements, the materials prepared according to the present invention take more than twice the time period before developing red rust as compared to SUS440C which is tempered at 480° C., and can ensure a sufficient wear resistance by selecting the hardness at 300° C. greater than Hv 610. It also can be seen that, by selecting the hardness at 300° C. greater than Hv 580, the wear resistance of the material can be made at least comparable to that of JIS-SUS440C used in a fuel injector for injecting fuel into an intake manifold (refer to the test criteria for the wear resistance tests).

On the other hand, #7 demonstrated the lowest high temperature hardness (Hv 580) of all the samples according to the present invention that were tested, and was therefore given the Δ rating for the wear test. Therefore, those samples which were not subjected to the durability tests are also expected to demonstrate favorable results as long as they demonstrate favorable results in the high temperature hardness tests and the wear resistance tests.

On the other hand, #15 demonstrating the high temperature hardness of only Hv 565 produced poor results in the wear tests and the durability tests, and its corrosion resistance was also poor. Furthermore, the average particle diameter of the primary carbides of #15 was as great as 16.4 μm, and marks of carbide dislodgement were observed in the valve seat surfaces and areas adjoining the seat surfaces after the durability tests. #16 and #17 intended for diesel engines had low Cu and Mo contents, and therefore had poor resistance to corrosion. The results of wear tests were also generally poor as #17 has a high temperature hardness of only Hv 545.

Thus, the nozzle needle and the valve seat made of the material according to the present invention are provided with favorable high temperature hardness, and, even after a hardening and high temperature tempering process, retains a favorable corrosion resistance as compared with the existing comparable materials. It shows that the material of the present invention is highly suitable for use in fuel injectors for injecting fuel directly into cylinders of gasoline engines.

Although the present invention has been described in terms of preferred embodiments thereof, it is obvious to a person skilled in the art that various alterations and modifications are possible without departing from the scope of the present invention which is set forth in the appended claims.

What we claim is:

1. A fuel injector component made of a martensite stainless steel for use in a fuel injector for injecting fuel directly into a combustion chamber of a clean-burn gasoline engine, said component being of a composition consisting essentially of, by weight:

0.6 to 1.5% of C;

2.0% or less of Si;

1.0% or less of Mn;

10 to 18% of Cr;

1 to 6% of a member selected from a group consisting of Mo and Mo+(½)W;

a balance of Fe and inevitable impurities; and wherein said fuel injection component is formed by the following process:

providing a fuel injector component with a desired shape;

hardening the fuel injection component by subjecting the fuel injector component to a temperature of from 1050° to 1100° C.;

cooling the fuel injector component; and tempering the fuel injector component at a temperature in a range of 450° C. to 550° C. so as to achieve a Vickers hardness at 300° C. of at least Hv 580.

2. A fuel injector component according to claim 1, further comprising 2% or less of V and Nb in terms of V+(½)Nb.

3. A fuel injector component according to claim 1, further comprising 6% or less of Co.

4. A fuel injector component according to claim 1, further comprising 3.5% or less of Cu.

5. A fuel injector component according to claim 1, further comprising 6% or less of Co, and 3.5% or less of Cu.

6. A fuel injector component according to claim 2, further comprising 6% or less of Co.

7. A fuel injector component according to claim 2, further comprising 3.5% or less of Cu.

8. A fuel injector component according to claim 2, further comprising 6% or less of Co, and 3.5% or less of Cu.

9. A fuel injector component according to any one of claims 1 through 8, further comprising at least one member of a group consisting of 0.2% or less of Pb, 0.05% or less of S, and 0.1% or less of Se.

10. A fuel injector component according to any one of claims 1 through 8, wherein an average particle diameter of a primary carbide is 15 μm or less.

11. A fuel injector component according to claim 1, wherein the step of tempering said fuel injector component achieves a Vickers hardness at 300° C. of at least Hv 610.

12. A fuel injector component according to claim 1 wherein said steel is a tempered steel including precipitated secondary carbides.

13. The fuel injector component according to claim 1 wherein the tempering step is performed under a vacuum and at a temperature of from 480° C. to 520° C.

14. The fuel injector component according to claim 1 wherein the cooling step is performed at a temperature below 0° C.

* * * * *